US005375986A

United States Patent [19]

Ukai et al.

[11] Patent Number: 5,375,986

[45] Date of Patent: Dec. 27, 1994

[54] OIL PUMP FOR A CLOSED TYPE COMPRESSOR

[75] Inventors: Tetuzou Ukai; Kimiharu Takeda, both of Aichi; Masumi Sekita, Nagoya, all of Japan

[73] Assignee: Mitsubishi Jukogyo Kabushiki Kaisha, Tokyo, Japan

[21] Appl. No.: 260,338

[22] Filed: Jun. 15, 1994

[30] Foreign Application Priority Data

Sep. 3, 1993 [JP] Japan ..... 5-219585

[51] Int. Cl.[5] ..... F01C 21/04

[52] U.S. Cl. ..... 418/88; 418/235; 418/54

[58] Field of Search ..... 418/88, 234, 235, 54

[56] References Cited

U.S. PATENT DOCUMENTS

| | | | |
|---|---|---|---|
| 993,530 | 5/1911 | Kinney | 418/235 |
| 1,876,370 | 9/1932 | Weber | 418/235 |
| 3,116,012 | 12/1963 | August | 418/235 |
| 5,176,506 | 1/1993 | Siebel | 418/88 |

*Primary Examiner*—Richard A. Bertsch
*Assistant Examiner*—Charles G. Freay
*Attorney, Agent, or Firm*—Arnold, White & Durkee

[57] ABSTRACT

An oil pump for a closed type compressor of the present invention is mounted in the inside bottom of a closed housing. In the oil pump, a rotor is driven to revolve by an eccentric shaft formed at the lower end of a rotary shaft for driving a compressing mechanism while the rotor is formed with a projection which is inserted into a slot of a cylinder chamber in order to inhibit the rotation of the rotor. In this arrangement, the root of the projection is cut away so that the projection is prevented from interfering with angled portions of an opening of the slot.

8 Claims, 4 Drawing Sheets

OIL PUMP FOR A CLOSED TYPE COMPRESSOR

BACKGROUND OF THE INVENTION

1. Field of the Invention

The present invention relates to an oil pump built in a closed type compressor for supplying a lubricant to sliding portions of the compressor.

2. Description of the Related Art

A typical upright closed type compressor such as scroll type compressors, rotary type compressors and the like is housed by a closed housing which is divided into two parts or upper and lower portions including a compressing mechanism and an electric motor, respectively. In such an arrangement, a rotary shaft of the electric motor is coupled with the compressing mechanism so that the compressing mechanism may be driven by the electric motor.

In general, in such closed type compressors, an oil pump is built in at a lower end of the rotary shaft. The oil pump sucks a lubricant oil reserved in an inside bottom of the closed housing to supply the oil to sliding portions of the compressing mechanism through an oil supplying channel formed inside the rotary shaft.

FIGS. 4 and 5 show a configuration of a conventional oil pump provided for the closed type compressor.

In the figure, reference numeral 1 designates a closed housing. Designated at 2 is a cylinder which is disposed in the inside bottom of closed housing 1. The cylinder 2 has a recess portion 2*a* defining a cylinder chamber 3. The cylinder 2 is integrally formed with a stay 4 whereby cylinder 2 is fixed to closed housing 1. Recess portion 2*a* is enclosed by a thrust plate 5 and a cover plate 6 attached to cylinder 2 to form the cylinder chamber 3.

A rotary shaft designated at 7 is inserted at a lower end thereof into cylinder 2. The lower end of the rotary shaft 7 is positioned inside cylinder chamber 3 and formed with an eccentric shaft 8. Designated at 9 is an annular rotor disposed inside cylinder chamber 3. The rotor 9 is fit rotatably on the periphery of eccentric shaft 8. The peripheral surface of the rotor comes into contact with the inner peripheral surface of cylinder chamber 3 to limit the space of cylinder chamber in a crescent shape.

A projection 10 in a form of blade extending radially is integrally formed on the periphery of rotor 9. The projection 10 is inserted slidably into a slot 11 radially formed on the inner peripheral surface of cylinder chamber 3. Projection 10 partitions cylinder chamber 3 into an oil feeding chamber 3*a* and an oil discharge chamber 3b while inhibiting rotor 9 from rotating. It should be noted that rotor 9 is substantially round or of a circle except the projection 10.

Formed in cover plate 6 is a sucking hole 12 which is positioned below oil feeding chamber 3*a* of the cylinder chamber 3. The sucking hole 12 communicates with the inside bottom of closed housing 1. Provided for thrust plate 5 is a sucking port 13 which communicates sucking hole 12 with oil feeding chamber 3*a* of cylinder chamber 3.

An ejecting passage 14 is provided in a cover plate 6. Provided on thrust plate 5 are an ejecting port 15 and a communicating hole 16. This ejecting port 15 communicates ejecting passage 14 with oil discharge chamber 3*b* of cylinder chamber 3 while the communicating hole 16 communicates ejecting passage 14 with an oil supplying channel 17 of rotary shaft 7. The oil supplying channel 17 is formed axially inside rotary shaft 7 from the bottom to the top. The inside bottom of closed housing 1 reserves lubricant.

Advantages of this oil pump are that damages to the rotor can be prevented and that the pump can be formed with a less number of parts since projection 10 is integrally formed with rotor 9.

In the thus constructed oil pump, as rotary shaft 7 is rotated by the electric motor, eccentric shaft 8 eccentrically rotates in a direction shown by the arrow in FIG. 5. This rotation causes eccentric shaft 8 to urge rotor 9 so that the rotor 9 revolves with its outer peripheral surface abutting the inner peripheral surface of cylinder chamber 3 in a line contact (sharing a line in the contact therebetween). Accordingly, as rotor 9 revolves, the volumes of oil feeding chamber 3*a* and oil discharge chamber 3*b* vary relatively, or one increases and the other decreases.

As the volume of oil feeding chamber 3*a* increases, the lubricant oil reserved in the inside bottom of closed housing 1 is sucked into oil feeding chamber 3*a* by way of sucking hole 12 of cover plate 6 and sucking port 13 of thrust plate 5. 0n the other hand, as the volume of oil discharge chamber 3*b* of cylinder chamber 3 decreases, the lubricant existing in oil discharge chamber 3*b* is pressurized to be ejected from ejecting port 15 of thrust plate 5. The ejected lubricant passes through ejecting passage 14 of cover plate 6 and communicating hole 16 of thrust plate 5 and is fed from the lower end of rotary shaft 7 into oil supplying channel 17. The lubricant is transported through the oil supplying channel 17, flowing out from the upper end of rotary shaft 7, to be delivered to and lubricate sliding portions in the compressing mechanism. After the lubrication, the lubricant flows down inside closed housing 1 to be re-collected in the bottom.

By the way, in the conventional oil pump, angled portions 18 formed on both sides of the opening of slot 11 disposed in the inner peripheral surface of cylinder chamber 3 in cylinder 2, are beveled forming slanting faces. More specifically, as the projection 10 of rotor 9 reciprocates slidingly inside slot 11, the root of projection 10 interferes with the angled portions 18 on both sides of the opening of slot 11. For this reason, the angled portions 18 are likely to be cracked or receive any other damages. To deal with this, the angled portions 18 on both sides of the opening of slot 11 is beveled in order to avoid any interference of the root of projection 10 with angled portions 18, whereby the angled portions are prevented from being cracked and damaged.

In general, a cylinder 2 is composed of metallic materials, and cylinder chamber 3 is formed by machining the cylinder 2 with a milling machine. Accordingly, angled portions 18 on both sides of the opening of slot 11 are also beveled by the machining process using the milling machine.

It is a very troublesome and difficult process, however, to bevel the narrow angled portions 18 on both sides of the opening of slot 11 by machining. Besides, the machining process leaves burrs on the beveled portions, so that the worker must remove the burrs after the machining. The necessity of the removal of burrs increases the number of steps for manufacturing the cylinder to thereby increase manufacturing costs.

SUMMARY OF THE INVENTION

The present invention has been achieved in view of what is discussed above and it is therefore an object of the present invention to provide an oil pump for a closed type compressor in which a cylinder having a slot for receiving a projection of a rotor is easily manufactured resulting in a reduction of the manufacturing cost.

In order to attain the above object, an oil pump for a closed type compressor of the present invention is built in a lower portion of the compressor and coupled with the lower end of a rotary shaft for driving a compressing mechanism held inside a closed housing and sucks a lubricant reserved in an inside bottom of the closed housing to deliver the lubricant through an oil supplying channel formed inside the rotary shaft to sliding portions of the compressing mechanism, and includes:

- a cylinder defining a cylinder chamber which locates around the lower part of the rotary shaft;
- an eccentric shaft provided at the lower end of the rotary shaft and located in the cylinder chamber;
- a rotor rotatably disposed in the cylinder chamber with being in sliding contact with the inner peripheral surface of the cylinder and being rotatably fit around and on the periphery of the eccentric shaft;
- a slot formed in an inner peripheral portion of the cylinder; and
- a projection integrally formed on an outer peripheral portion of the rotor for partitioning the inside space of the cylinder chamber into an oil feeding chamber and a oil discharge chamber and inserted movably into the slot,
- wherein the rotor having cutout portions on the outer periphery at the root of the projection.

In the oil pump, the cutout portions are formed in the root of the projection on the outer periphery of the rotor, so that it is possible to avoid interference of basal parts of the projection with angle portions of the opening of the slot as the projection of the rotor slidingly reciprocates inside the slot formed on the inner periphery of the cylinder chamber. As a result, it is possible to prevent the angled portions of the opening on both sides from being cracked or damaged.

The rotor used in the oil pump of this kind is usually made of a synthetic resin and formed by a process using a mold such as the injection molding. Therefore, if the rotor is designed to have cutout portions on the outer periphery at the root of the projection, the cutout portion positioned at the root of the projection can be formed at the same time the rotor is formed.

Accordingly, since the rotor has cutout portions formed on the outer periphery thereof, it is no longer necessary to carry out an additional work such as beveling of angled portions of the opening of slot as used to be effected in the prior art. Needless to say, it is no longer necessary to perform a post-treatment such as removal of burrs from the beveled portions as used to carried out. In this respect, no additional step is required. Moreover, the cutout portions on the outer periphery of rotor can be easily formed at the same time the rotor is molded.

DETAILED DESCRIPTION OF PREFERRED EMBODIMENTS

An embodiment of the present invention will be hereinafter be described with reference to FIGS. 1 through 3.

First, referring to FIG. 1, description will be made on a scroll type compressor as an example of closed type compressors having an oil pump of the present invention.

Figure 1:
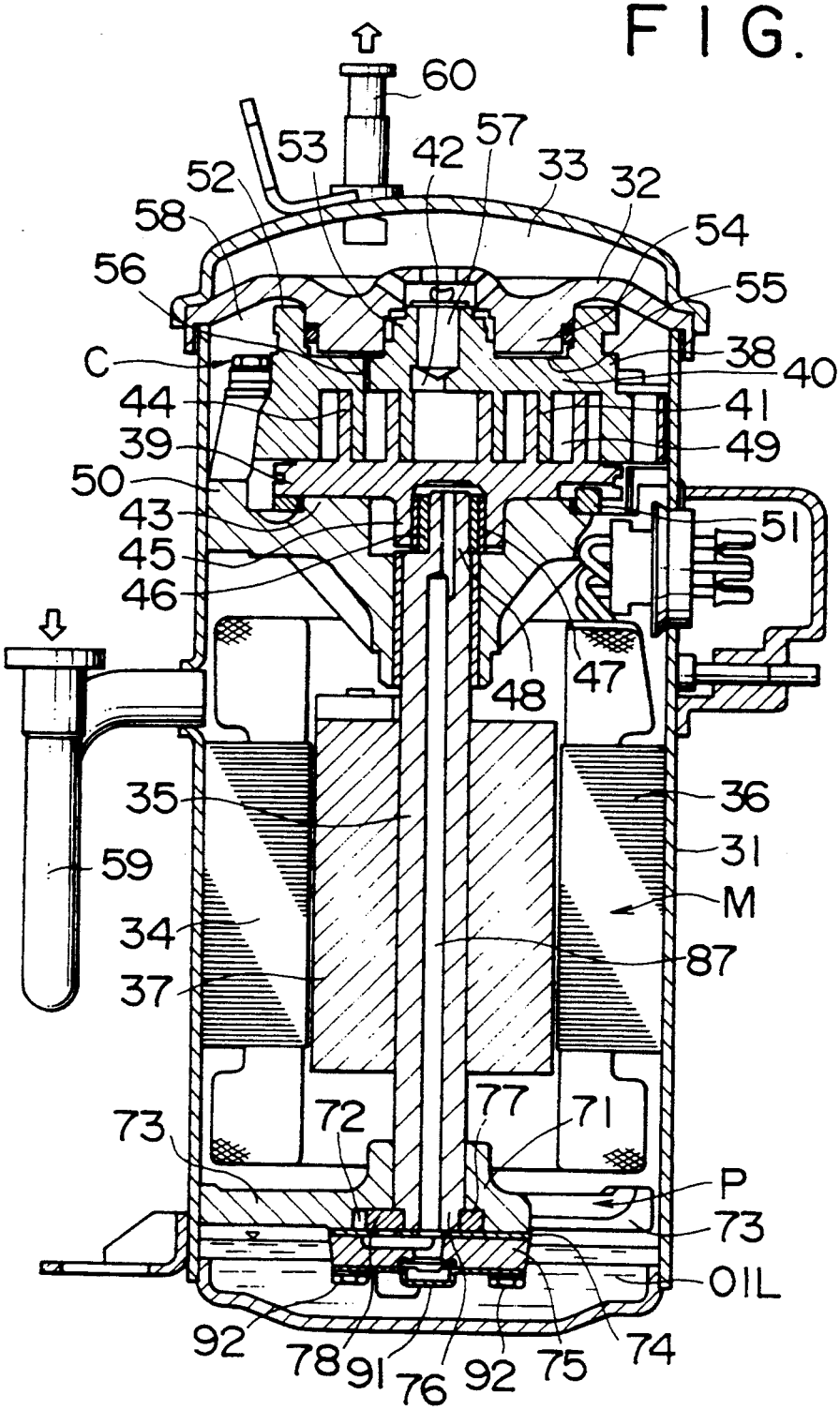
FIG. 1 is a sectional view showing a scroll type compressor equipped with an oil pump in accordance with one embodiment of the present invention.

In FIG. 1, the inside of a closed housing 31 is partitioned by a discharge cover 32 into two spaces, namely, a high-pressure space 33 and a low-pressure space 34. Inside low-pressure space 34, a scroll type compressing mechanism C and an electric motor M are provided in upper and lower portions, respectively. Provided at the bottom of low-pressure space 34 (at the bottom of closed housing 31) is an oil pump P of the present invention. These scroll type compressing mechanism C, electric motor M and oil pump P are coupled together by a rotary shaft 35 of electric motor M.

Electric motor M comprises a stator 36 fixed in closed housing 31, a rotor 37 mated inside the stator 36 and rotary shaft 35 secured through the rotor 37. The rotary shaft 35 extends from both upper and lower sides of rotor 37.

Scroll type compressing mechanism C has a fixed scroll 38 and a revolving scroll 39. The fixed scroll 38 comprises an end plate 40 and a spiral lap 41. End plate 40 is provided with an ejecting port 42. Revolving scroll 39 comprises an end plate 43 and a spiral lap 44. End plate 43 has a boss 45 formed on the undersurface thereof. A bushing is rotatably fit into the boss 45 through a bearing 47. An eccentric shaft 48 disposed at the upper end of rotary shaft 35 is slidably inserted into the bushing 46.

Fixed scroll 38 and revolving scroll 39 are made eccentric from one another by a predetermined distance while laps 41 and 44 are shifted from one another by 180 degrees to define in combination a plurality of closed spaces 49 therebetween. Revolving scroll 39 is supported slidably on a casing 50 fixed inside closed housing 31. Disposed between revolving scroll 39 and casing 50 is anti-rotation mechanism 51 for allowing the revolving scroll 39 to revolve but inhibiting it from rotating.

The outer periphery of end plate 40 of fixed scroll 38 is supported floatably by casing 50. Cylindrical flanges 52 and 53 are disposed concentrically on the top surface of end plate 40 of fixed scroll 38. A cylindrical flange 54 disposed on the undersurface of discharge cover 32 is hermetically but slidably mated between the flanges 52 and 53. A space enclosed by flanges 52, 53 and 54 forms a backing pressure chamber 55, which communicates through a hole 56 provided in end plate 40 with a closed space 49 in which a gas is being compressed. Here, hole 56 is disposed at such a position as to be in contact with the inner periphery of lap 41. A high-pressure chamber 57 is formed on the inner periphery of backing pressure chamber 55 while a low-pressure chamber 58 is formed on the outer periphery of the same. It should be noted that a gas sucking tube 59 is provided for low-pressure space 34 of closed housing 31 while a gas ejecting tube 60 is provided for high-pressure space 33.

In the scroll type compressor thus constructed, rotary shaft 35 is rotated as motor M drives. This rotation is transmitted through eccentric shaft 48, bush 46 and boss 45 to revolving scroll 39 in compressing mechanism C. The revolving scroll 39 revolves on an circular obit having a certain revolving radius while being inhibited from rotating by antirotating mechanism 51.

This revolving movement of scroll 39 leads a gas to enter low-pressure space 34 of closed housing 31 through sucking tube 59. The thus introduced gas is sucked into a closed space 49 of compressing mechanism C by way of a passage not shown in the figure. Then, the sucked gas is compressed and pushed to the center portion as the volume of closed space 49 reduces due to the revolving movement of revolving scroll 39. The centered gas is lead through ejecting port 42 to high-pressure chamber 57, entering high-pressure space 33 to be discharged through gas ejecting tube 60 to the outside.

In this while, leakage of the gas from the inside of closed space 49 is protected since fixed scroll 38 is pressed against revolving scroll 39 by the gas pressure inside high-pressure chamber 57 and backing pressure chamber 55. If a liquid is sucked into the inside of closed space 49, fixed scroll 38 floats upward to release the liquid so as to prevent the compressing mechanism from being damaged.

Figure 2:
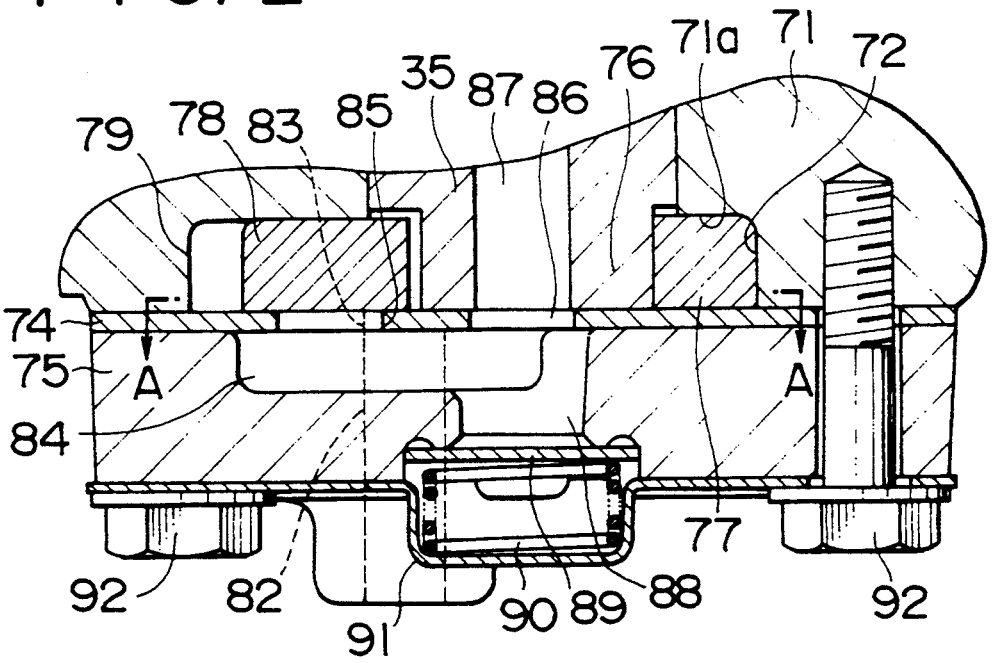
FIG. 2 is an enlarged, sectional view showing the oil pump shown in FIG. 1.
Figure 3:
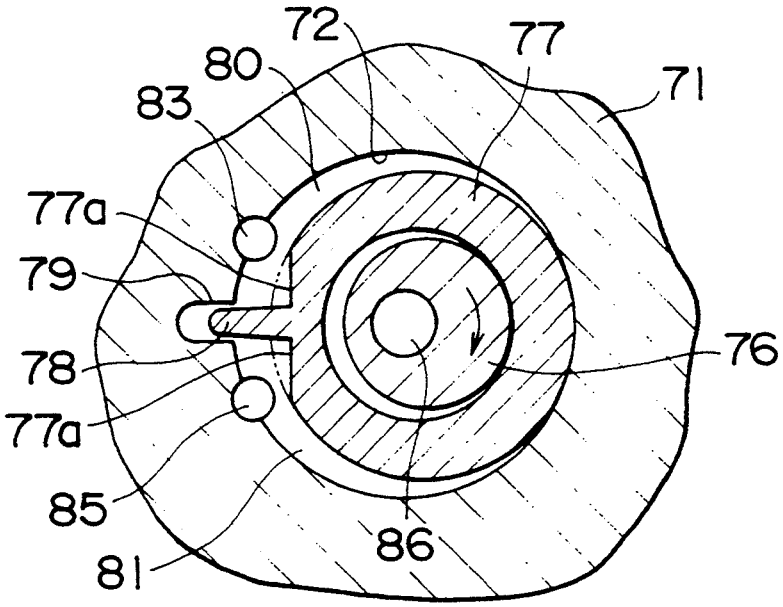
FIG. 3 is a sectional view taken on a line A—A in FIG. 2.
Figure 4:
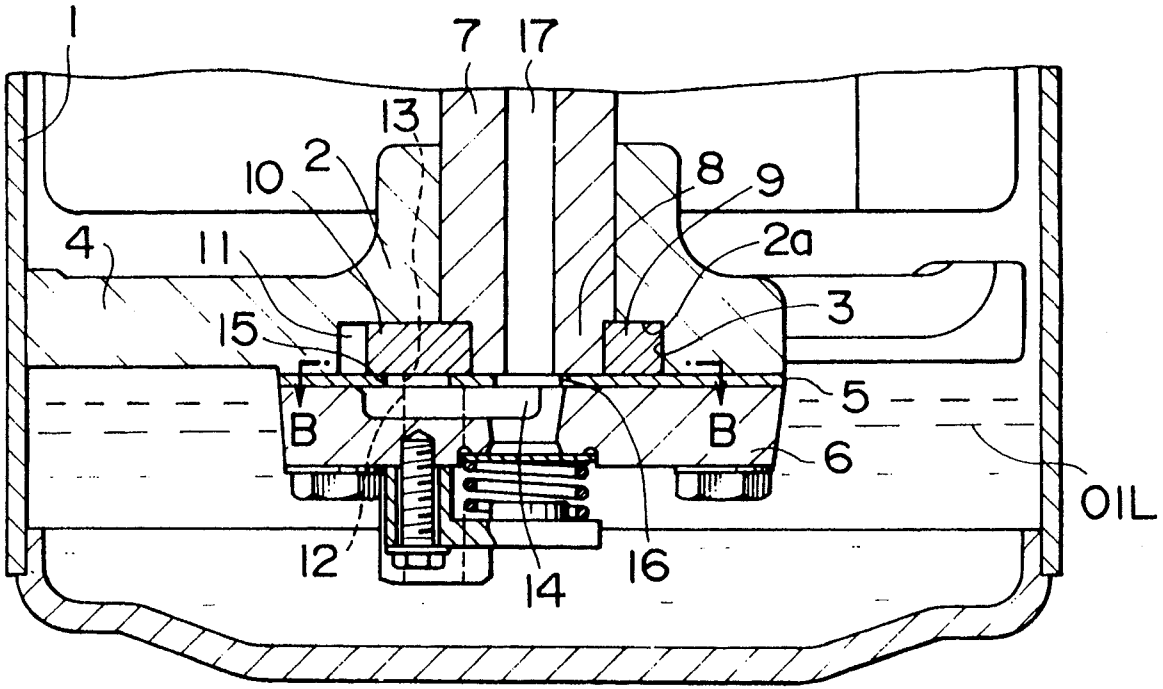
FIG. 4 PRIOR ART
FIG. 4 is a sectional view showing a prior art oil pump.
Figure 5:
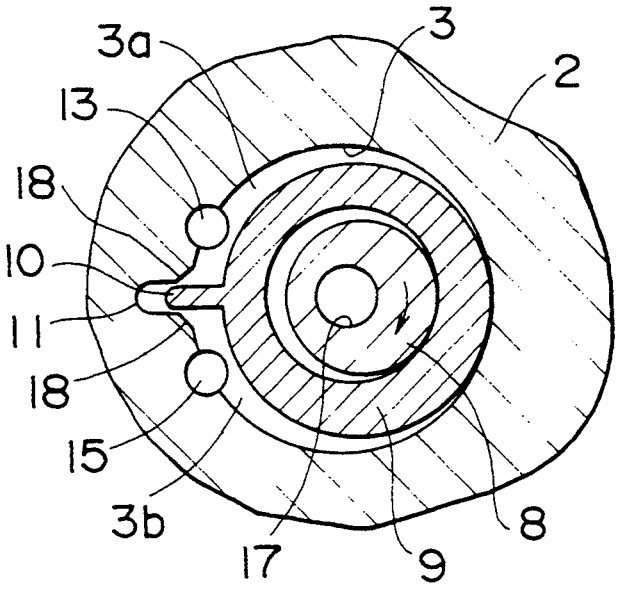
FIG. 5 PRIOR ART
FIG. 5 is a sectional view taken on a line B—B in FIG. 4.

Referring now to FIGS. 1 through 3, description will be made on one embodiment of an oil pump P to be targeted by the present invention.

In the figures, reference numeral 71 designates a cylinder fixedly positioned at the inside bottom of closed housing 31. This cylinder 71 has a recess 71*a* defining a cylinder chamber 72 opened downward and is fixed to closed housing 31 by means of a stay 73 integrally formed with cylinder 71. Recess 71*a* of cylinder 71 is confined by a blocking means, for example, by a thrust plate 74 and a cover plate 75 fixed to cylinder 71 with a bolt 92, thereby forming cylinder chamber 72.

Rotary shaft 35 is inserted at the lower end thereof into cylinder 71. The lower end of the rotary shaft 35 located inside cylinder chamber 72 is formed with an eccentric shaft 76. Designated at 77 is an annular rotor provided inside cylinder chamber 72. The rotor 77 is fit rotatably with the periphery of eccentric shaft 76. The peripheral surface of the rotor comes into contact with the inner peripheral surface of cylinder chamber 72 to limit the space of cylinder chamber in a crescent shape. A projection 78 in a form of blade extending radially is integrally formed on the outer periphery of rotor 77. The projection 78 is inserted slidably into a slot 79 radially formed on the inner peripheral surface of cylinder chamber 72. Projection 10 partitions cylinder chamber 72 into an oil feeding chamber 80 and an oil discharge chamber 81 while inhibiting rotor 77 from rotating.

Further, parts of the outer periphery of rotor 77 on both sides at the root of projection 78 are cut away to form cutout portions 77*a*. These cutout portions 77*a* are provided in order to avoid the interference of the basal parts of projection 78 with the angled portion of the opening of slot 79 which would be caused as projection 78 of rotor 77 slidingly reciprocates inside slot 79 formed in the inner periphery of cylinder 79. These cutout portions 77*a* are formed such that the outer periphery of rotor 77 forming an arced surface shown by an imaginary line in FIG. 3 is cut away by solid lines illustrated that abut projection 78 at substantially right angles. The size of cutout portion 77*a* is defined so as to allow the root of projection 78 to avoid interfering with the angled portions of the opening of slot 79.

Here, rotor 77 is made of a synthetic resin and the whole part of the rotor including projection 78 and cutout portions 77*a* is integrally formed by, for example, the injection molding.

Formed in cover plate 75 is a sucking hole 82 which is positioned below oil feeding chamber 80 of the cylinder chamber 72. The sucking hole 82 communicates with the inside bottom of closed housing 31. Provided for thrust plate 74 is a sucking port 83 which communicates sucking hole 82 with oil feeding chamber 80 of cylinder chamber 72.

An ejecting passage 84 is provided in a cover plate 75. Provided on thrust plate 74 are an ejecting port 85 and a communicating hole 86. This ejecting port 85 communicates ejecting passage 84 with oil discharge chamber 81 of cylinder chamber 72 while the communicating hole 86 communicates ejecting passage 84 with an oil supplying channel 87 of rotary shaft 35.

Here, oil supplying channel 87 is formed axially inside rotary shaft 35 from the bottom to the top. The inside bottom of closed housing 31 reserves a lubricant.

In the figures, reference numeral 89 designates a check valve that opens or blocks a release opening 88 formed in cover plate 75 at an intermediate portion of ejecting passage 84. Designated at 90 is a spring which gives blocking force against check valve 89. A spring support 91 is served to support spring 90.

In the thus constructed oil pump, as rotary shaft 35 is rotated by the electric motor M, eccentric shaft 76 eccentrically rotates in a direction shown by the arrow in FIG. 3. This rotation causes eccentric shaft 76 to urge rotor 77 so that the rotor 77 revolves with its outer peripheral surface abutting the inner peripheral surface of cylinder chamber 71 in a line contact (sharing a line in the contact therebetween). Accordingly, as rotor 77 revolves, the volumes of oil feeding chamber 80 and oil discharge chamber 81 vary relatively, or one increases and the other decreases.

As the volume of oil feeding chamber 80 increases, the lubricant reserved in the inside bottom of closed housing 31 is successively sucked into oil feeding chamber 80 by way of sucking hole 82 of cover plate 75 and sucking port 83 of thrust plate 74.

On the other hand, as the volume of oil discharge chamber 81 of cylinder chamber 72 decreases, the lubricant existing in oil discharge chamber 81 is pressurized to be ejected from ejecting port 85 of thrust plate 74. The ejected lubricant passes through ejecting passage 84 of cover plate 75 and communicating hole 86 of thrust plate 74 and is fed from the lower end of rotary shaft 35 into oil supplying channel 87. The lubricant is transported through the oil supplying channel 87, flowing out from the upper end of rotary shaft 35, to be delivered to and lubricate sliding portions in the compressing mechanism C. After the lubrication, the lubricant flows down inside closed housing 31 to be re-collected in the bottom.

In the oil pump, cutout portions 77*a* are formed at the root of projection 78 in the outer periphery of rotor 77, so that it is possible to avoid the interference of basal parts of projection 78 with angle portions of the opening of slot 79 as the projection 78 of rotor 77 slidingly reciprocates inside slot 79 formed on the inner periphery of cylinder chamber 72. As a result, it is possible to prevent the angled portions of the opening on both sides from being cracked or damaged.

Rotor 77 used in the oil pump of this kind is usually made of a synthetic resin and formed by a process using a mold such as the injection molding. Therefore, when a rotor 77 is formed, cutout portion *77a* positioned at the root of projection 78 can be formed at the same time.

Accordingly, since rotor 77 has cutout portions 77 formed on the outer periphery thereof, it is no more necessary to carry out an additional work such as beveling of angled portions of the opening of slot as used to be effected in the prior art. Needless to say, it is no more necessary to perform a post-treatment such as removal of burrs from the beveled portions as used to carried out, therefore also in this respect, no more additional step is required. Moreover, the cutout portions *77a* on the outer periphery of rotor 77 can be formed at the same time the rotor 77 is formed. Accordingly, it is possible to manufacture the rotor 77 in a less number of steps at a lower manufacturing cost.

It should be understood that the present invention is not limited to the embodiment described heretofore, and many variations and modifications can be made. For example, although a scroll type compressing mechanism is adapted in the above embodiment, it is also possible to employ a rotary type compressing mechanism.

As described heretofore, according to the oil pump for a closed type compressor of the present invention, the portions located at the root of the projection on the outer periphery of the rotor are cut away in order to avoid the interference of the projection formed on the outer periphery of the rotor with the angled portions of the opening of the slot formed on the inner periphery of the cylinder. Therefore, it is possible to form the cutout portions located at the root of the projection at the same time the rotor is formed by the process using a mold such as the injection molding.

As a result, since the rotor has cutout portions formed on the outer periphery thereof, it is no more necessary to carry out an additional work such as beveling of angled portions of the opening of slot as used to be effected in the prior art. Needless to say, it is no more necessary to perform a post-treatment such as removal of burrs from the beveled portions as used to carried out. Moreover, the cutout portions on the outer periphery of the rotor can be formed easily at the same time the rotor is formed. Accordingly, it is possible to manufacture the rotor in a less number of steps at a lower manufacturing cost.

What is claimed is:

1. An oil pump for a closed type compressor, which is built in a lower portion of the compressor and coupled with the lower end of a rotary shaft for driving a compressing mechanism held inside a closed housing and sucks a lubricant reserved in an inside bottom of said closed housing to deliver the lubricant through an oil supplying channel formed inside said rotary shaft to sliding portions of said compressing mechanism, said oil pump comprising:

a cylinder defining a cylinder chamber which locates around the lower part of said rotary shaft;

an eccentric shaft provided at the lower end of said rotary shaft and located in said cylinder chamber;

a rotor rotatably disposed in said cylinder chamber and being in sliding contact with the inner peripheral surface of said cylinder and being rotatably fit around and on the periphery of said eccentric shaft;

a slot formed in an inner peripheral portion of said cylinder; and a projection integrally formed on an outer peripheral portion of said rotor for partitioning the cylinder chamber into an oil feeding chamber and a oil discharge chamber and inserted movably into said slot, said rotor having cutout portions on the outer periphery at the root of said projection.

2. An oil pump for a closed type compressor according to claim 1 wherein said cylinder is integrally formed with a stay and fixed by means of said stay.

3. An oil pump for a closed type compressor according to claim 2 wherein said cylinder chamber is hermetically enclosed by attaching a thrust plate and a cover plate onto an underside opening of said cylinder.

4. An oil pump for a closed type compressor according to claim 3 wherein both said thrust plate and cover plate have a sucking passage for sucking the lubricant reserved inside said closed housing into said oil feeding chamber in said cylinder chamber and an ejecting passage for leading the lubricant to be ejected from said discharge oil chamber in said cylinder chamber to said oil supplying channel inside said rotary shaft.

5. An oil pump for a closed type compressor according to claim 1 wherein the cutout portions of said rotor are sized such that the root of said projection will not interfere with the angle portions of the opening of said slot.

6. An oil pump for a closed type compressor according to claim 5 wherein said cutout portions are disposed on both sides of the root of said projection.

7. An oil pump for a closed type compressor according to claim 1 wherein said rotor is made up of a synthetic resin molded article.

8. An oil pump for a closed type compressor according to claim 7 wherein said rotor is integrally formed with said projection and said cutout portions.

* * * * *